United States Patent [19]

Fichte et al.

[11] 4,406,447

[45] Sep. 27, 1983

[54] DEVICE FOR POSITIONING A SHEET SEPARATOR

[75] Inventors: Frank Fichte, Taucha; Wolfgang Paul, Leipzig, both of German Democratic Rep.

[73] Assignee: VEB Kombinat Polygraph "Werner Lamberz" Leipzig, Leipzig, German Democratic Rep.

[21] Appl. No.: 296,223

[22] Filed: Aug. 25, 1981

Related U.S. Application Data

[63] Continuation-in-part of Ser. No. 290,791, Aug. 6, 1981.

[30] Foreign Application Priority Data

Aug. 6, 1980 [DD] German Democratic Rep. ... 223123

[51] Int. Cl.[3] ..... B65H 3/08

[52] U.S. Cl. ..... 271/31; 271/110; 271/117; 271/153; 271/171

[58] Field of Search ..... 271/18, 30 R, 31, 110, 271/111, 117, 142, 227, 241, 254, 265, 153, 154, 171

[56] References Cited

U.S. PATENT DOCUMENTS 3,804,402 4/1974 Hottendorf ..... 271/171 X 4,200,277 4/1980 Klenk ..... 271/153

*Primary Examiner*—Richard A. Schacher

*Attorney, Agent, or Firm*—Michael J. Striker

[57] ABSTRACT

A device for positioning a sheet separator for a stack of sheets in a sheet feeder includes a drive for the sheet separator operable for moving the latter in two opposite directions. A stop gauge for the rear edge of the sheet stack is slidably supported on an insulating block which is rotatable on the sheet separator. The lower end of the stop gauge is provided with a feeler roller to engage the upper side of the stack, and the opposite end of the stop gauge is provided with a flag cooperating with an inductive switch. The latter switch controls the direction of rotation of the driving motor for the separator. The rotary block controls another switch which stops the motor when the separator attains its desired position. A light barrier switch is arranged at the level of the desired height of the stack and determines the active or inactive condition of the positioning device.

9 Claims, 6 Drawing Figures

FIG. 1
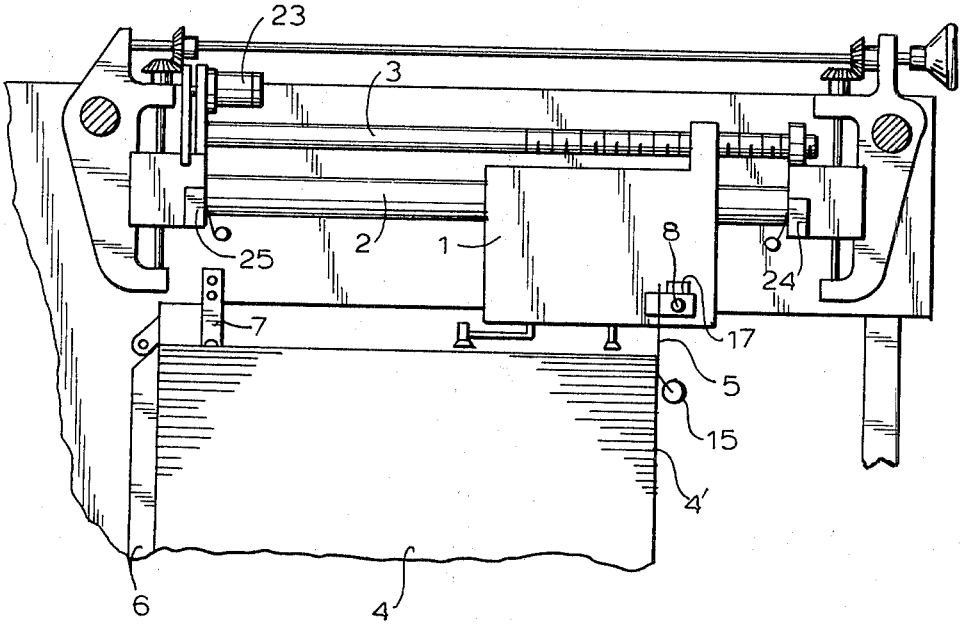
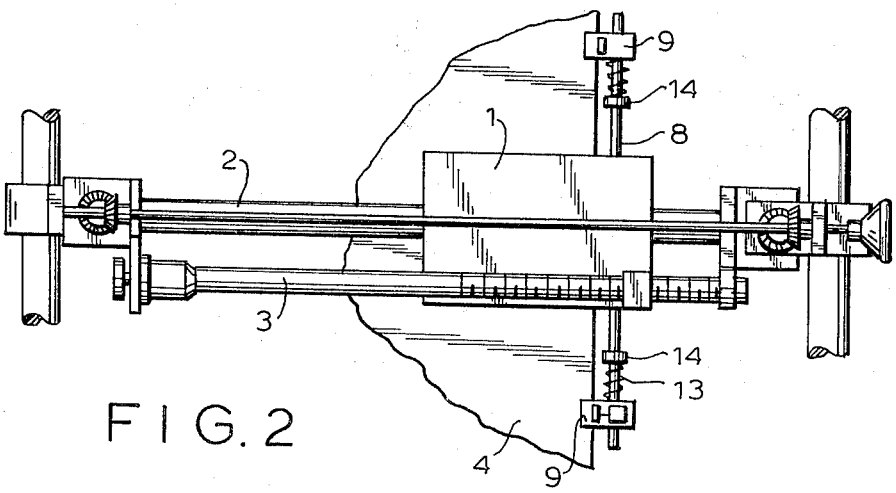
FIG. 2

DEVICE FOR POSITIONING A SHEET SEPARATOR

CROSS-REFERENCE TO RELATED APPLICATION

This application is a Continuation-in-Part application of our copending application Ser. No. 290,791, filed Aug. 6, 1981 and entitled DEVICE FOR FORMAT SIZE POSITIONING OF THE SHEET SEPARATOR IN SHEET FEEDERS.

BACKGROUND OF THE INVENTION

The present invention relates in general to a sheet feeding apparatus, and in particular to an apparatus of the type having a displaceable sheet separator and means for positioning the sheet separator according to the format of sheets when a new stack of sheets of different format is applied to the feeding apparatus.

German published patent application No. 27 50 105 discloses a device by means of which stop gauges of sheet processing machines are adjustable according to the size of sheets under process. In this known device, among other measures, the stop gauges are fixedly arranged in the direction of advance of the sheet on the sheet separator and are displaced together with the sheet separator by means of power-driven screw spindles, for example. The desired measure of the format corresponding to the processed sheets is determined by means of a feeler head arranged on a special measuring rod.

It is true that by means of these prior-art measures a decrease in manual operation is achieved, but this known device requires complicated technology for the positioning devices, including electronic preselection devices with digital read-out. Another disadvantage of this known device is the fact that upon the entry of data pertaining to a new format of processed material, the sheet separator travels to the given position without regard to the actual position of the stack. In practice, the outer contours of the stack and thus the position of the stack deviate frequently from the format of individual sheets, and therefore a difference between a theoretical position of the stack and the actual position thereof frequently occurs. In this event, time-consuming position corrections are necessary. Moreover, during such corrections the possibility exists that the upper layers of the stack may be damaged by stop gauges, inasmuch as the stack position variations occur most frequently as an enlargement of the sheet format.

In the GDR Pat. No. 107,638 a method of adjusting elements of a printing machine according to the format of the processed sheets is disclosed. In this known method, a sensing device is also moved synchronously with the movement of elements being adjusted relative to an edge of the sheet, whereby the drives for the elements and for the sensing device are disconnected when the latter abuts against the edge of the sheet stack. This method solves the problem of adjusting the position of a sheet separator according to a new format of the sheets only partially; it presumes again that in a format exchange the sheet separator be brought into a zero or starting position from which it can be displaced always in one positioning direction only. If the adjustment into the starting position after the feeding of a new sheet stack be incidentally omitted, breakage of machine elements and damage of the sheet stack might result.

SUMMARY OF THE INVENTION

It is therefore a general object of the present invention to overcome the aforementioned disadvantages.

More particularly, it is an object of the invention to provide an improved positioning device for a sheet separator of the above-described type which reduces technology expenditures.

An additional object of the invention is to provide such an improved positioning device which speeds up the positioning operation.

A further object of the invention is to provide such an improved format-dependent positioning device which takes into account the actual position of the new sheet stack and automatically adjusts itself to a new format according to the actual position of the rear edge of the sheet stack, irrespective of the nominal format of the sheets.

In keeping with these objects and others which will become apparent hereafter, one feature of the invention resides, in a position adjuster for a sheet separator of the aforedescribed type, in the provision of means which control the adjuster not only relative to the rear edge of the sheet stack but also relative to the upper level of the stack.

According to another feature of this invention, the adjuster includes stop gauges for the stack which act as a feeler, particularly for the rear edge of the stack, and controls the operation of the adjuster.

This feeler is tiltably mounted on a guide rod which in turn is rigidly connected to the sheet separator and guidably supports the feeler by means of an electrically insulating block. The feeler is in the form of a stop gauge formed at its end with a feeler roller engageable with the rear side of the stack. The opposite end of the feeler is provided with an inductive element which cooperates with an inductive switch arranged on the insulating block. The block together with the feeler is spring-biased into a predetermined angular position by means of a torsion spring arranged around the guiding rod and attached at one end to the insulating block.

According to still another feature of this invention, there is provided a light barrier in the range of the top surface of the sheet stack, and this light barrier together with the inductive switch controls a power supply circuit for a drive motor of the sheet separator. A device for interrupting the supply current is activated when the sheet separator is displaced to the desired position and remains activated until the subsequent interruption of the light barrier. At the same time, when the sheet separator has reached its desired position, a ground potential is interrupted by the aforementioned switch on the insulating block.

Of particular advantage in this invention is the fact that the sheet separator adjusts itself automatically to the actual position of the rear edge of the sheet stack independently of its original position. As a consequence, both the technological and operational expenditures for the position adjuster are considerably reduced in comparison with prior-art adjusters.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a partial side view of a sheet feeder having a position-adjustable sheet separator;

FIG. 2 is a top view of the sheet feeder of FIG. 1;

DESCRIPTION OF THE PREFERRED EMBODIMENTS

Figures 3, 4:
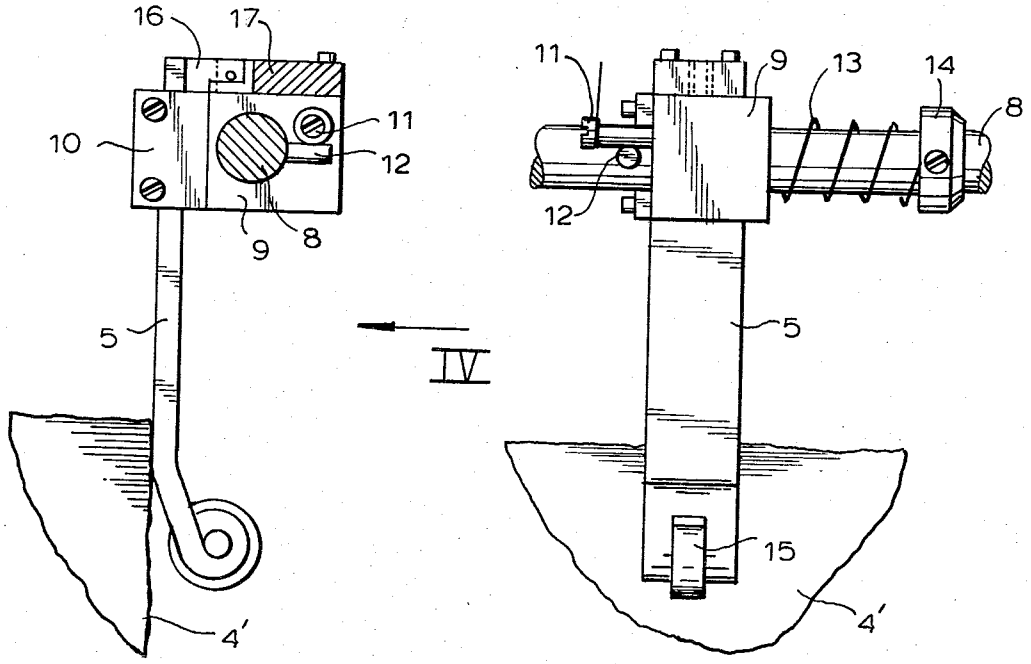
FIG. 3 is a side view of a stop gauge provided with a feeler for the rear edge of the stack.
FIG. 4 is a rear view of the stop gauge of FIG. 3 when viewed in the direction of arrow IV.
Figure 6:
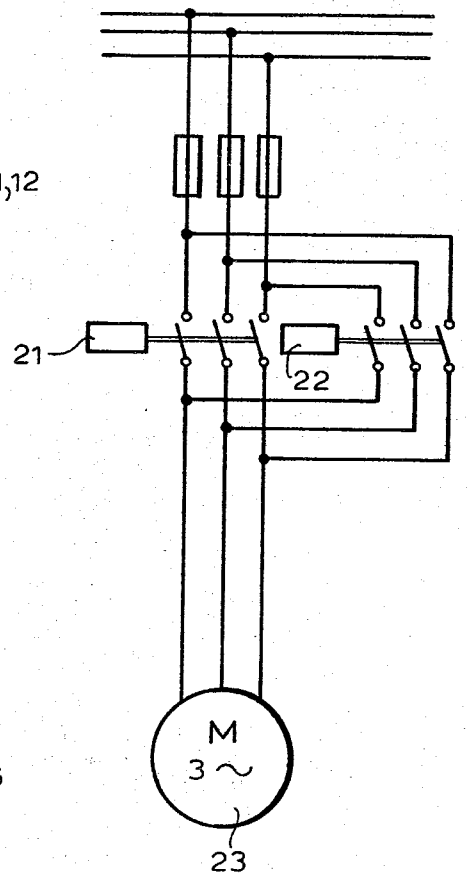
FIG. 6 is a circuit diagram of a driving motor for a sheet separator according to this invention.

A sheet separator 1 for use in a sheet feeder slides on a supporting shaft 2 and is advanced in sheet-feeding direction by means of a screw spindle 3. A sheet stack 4 is placed under the path of movement of separator 1. The rear edge 4' of stack 4 is acted upon by stack stop gauges 15 whereas the front edge of the stack abuts against front stop gauges 6. At the level of the desired height of the introduced sheet stack 4 a light barrier 7 is installed for actuating a switching device, as will be described below. The stack stop gauges 5 are mounted on a supporting rod 8 which in turn is fixed on the sheet separator 1 and extends transversely relative to the supporting shaft 2, as seen from FIGS. 1 and 2.

Referring to FIGS. 3 and 4, it will be seen that each stop gauge 5 is supported for sliding movement in a vertical guide 10 which is secured to a block 9 made of an electrically insulating material. The block 9 is rotatably supported at a fixed location on the supporting rod 8. A contact pin 11 projects from block 9 parallel to supporting rod 8 and is engageable with another contact pin 12 projecting in radial direction from the rod 8. The mutual positions of contact pins 11 and 12 relative to the sliding guide 10 are set so that the rotation of block 9 with the pin 11 in clockwise direction is stopped by the stationary pin 12 when the stop gauge 5 is in vertical position. The movement in clockwise direction is imparted to the block 9 by a torsion spring 13 wound around the rod 8 and being secured at one end to a set screw ring 14 and at the other end to the block 9. Spring 13 is biased so that pin 11 be normally in contact with the stationary pin 12. The lower end portion of stop gauge 5 is slightly bent away from the rear side 4' of the stack and supports a feeler roller 15. The opposite upper end of stop gauge 5 is provided with a control flag 16 which cooperates with an inductive proximity switch 17 mounted on the upper side of each block 9. The inductive switch 17 cooperates with contact pins 11 and 12 and with light barrier 7 in a manner illustrated in circuit diagram in FIG. 5. Both the transmitter 7' of light barrier 7 and the inductive switch 17 are operatively connected to an amplifier 18 to control two switching relays 19 and 20. Additional relays or magnetic switches 21 and 22 control switches for driving motor 23 which drives via suitable transmission gears the screw spindle 3. The magnetic switches 21 and 22 are energized or deenergized via end position switches 24 and 25, contacts 19' of relay 19 and contacts 20' of relay 20, and via contact 27'' of an auxiliary relay 27 the coil of which is bridged by a storing capacitor 28. Another auxiliary relay 26 is controlled by the aforementioned contact pins 11 and 12 which brake and make the ground potential. Contact 26' of auxiliary relay 26 is connected in series with the magnetic switch 22.

Upon introducing a sheet stack 4 between the transmitter 7' and the receiver 7'' of light barrier 7, relay 20 is activated through amplifier 18 and closes its contacts 20'. In doing so, the device for positioning the sheet separator 1 is brought into its operative condition.

In principle, there are required two regulating processes resulting from a more or less accidental or random position of sheet separator 1 relative to the introduced sheet stack 4.

Figure 5:
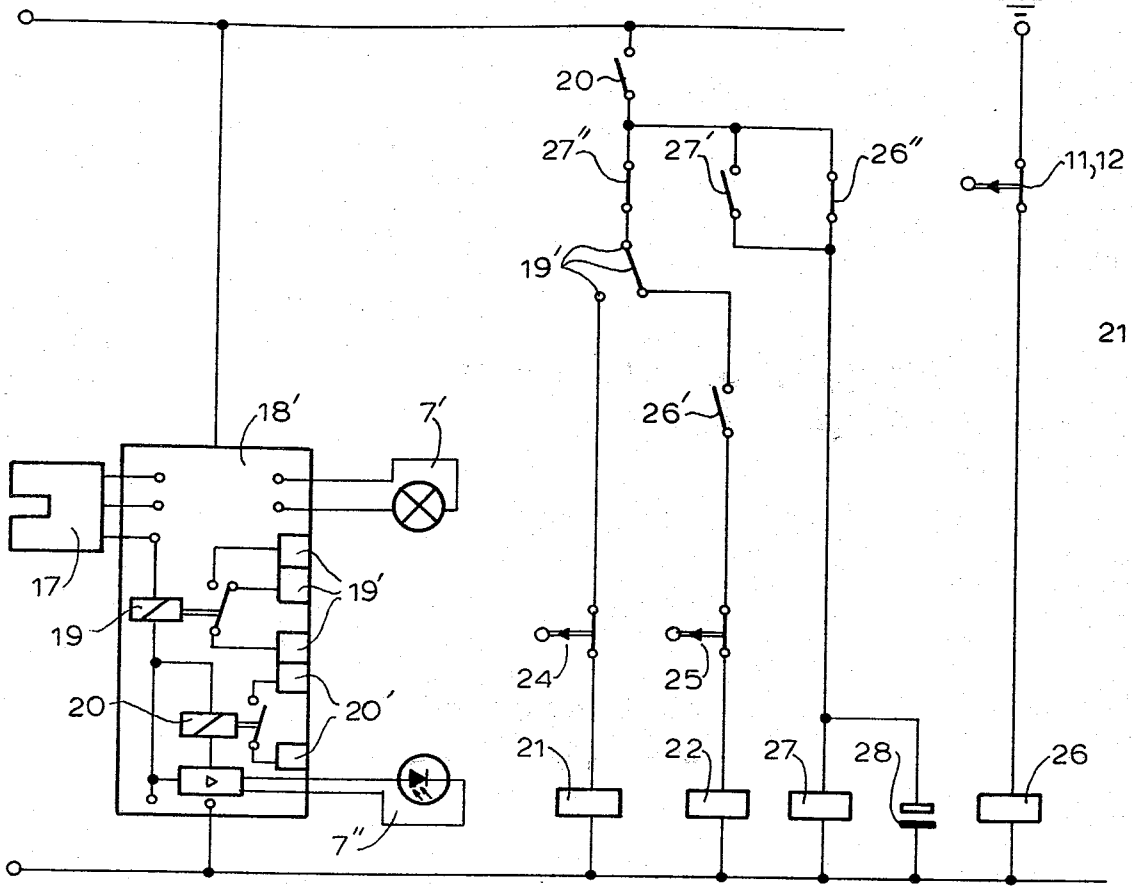
FIG. 5 is a schematic circuit diagram of a part of switching means for the position adjuster according to this invention.

If for instance a rear stop gauge 5 on sheet separator 1 is situated above the upper surface of sheet stack 4, then in introducing a new stack the stop gauge 5 is displaced in its sliding guide 10 upwardly and consequently the control flag 16 is displaced out of the range of the inductive switch 17. The latter switch operates according to the principle of a discontinuity-responsive generator having a power output generating either a 0 or low (L), or a 1 or high (H) output. In the latter case, relay 19 is energized via amplifier 18 and contacts 19' of relay 19 switch over the magnetic switch 21 so that the latter becomes energized and its contacts close the power supply lines for the driving motor 23 in such a manner that the latter drives via screw spindle 3 the sheet separator 1 rearwardly against the sheet-feeding direction until the stack stop guage 5 passes the rear edge 4' of the latter and slides downwardly in the guide 10. As a result, flag 16 is again brought into the range of the inductive switch 17 so that the latter generates again a 0 or low (L) signal which deactivates relay 19 and contacts 19' return to their initial position as indicated in FIG. 5.

In this initial or normal position of contact 19', the other magnetic switch 22 becomes energized, and driving motor 23 is switched over to rotate in the opposite direction in which sheet separator starts moving in a feeding direction for so long until the rear stop gauge 5 is angularly displaced about its supporting rod 8. Due to this angular displacement, the contact between pins 11 and 12 is interrupted, and consequently the auxiliary relay 26 is activated in such a manner that its contact 26' is opened and simultaneously its other contact 26' is closed. In opening contact 26', magnetic switch 22 becomes deenergized and driving motor 23 is stopped. At the same time, due to the closing of contact 26' the auxiliary relay 27 is activated and its contacts 27' are closed and its additional contacts 27'' are opened. Due to the opening of contacts 27'', the function of the positioning device is discontinued. The storing capacitor 28 prevents overlapping of relay contacts.

In the case when during the introduction of a new sheet stack 4 the stop gauages 5 on the sheet separator 1 are not situated above the upper surface of the stack but behind its rear edge 4', it is only the light barrier 7 which activates relay 20 to initiate the function of the positioning device while stack 16 is opposite the inductive switch 17 so that the latter generates a zero (L) signal which immediately energizes the magnetic switch 22, and the positioning of sheet separator 1 in the feeding direction proceeds in the manner described above. With the aid of auxiliary relays 26 and 27 and with capacitor 28, a storage circuit is created which is effective for the subsequent interruption of the light barrier, and consequently the positioning movement of the sheet separator against the feeding direction takes place only in response to the change of format of the sheet stack when the inductive switch is activated.

It will be understood that each of the elements described above, or two or more together, may also find a useful application in other types of constructions differing from the types described above.

While the invention has been illustrated and described as embodied in feeders for sheet processing machines, such as printing machines, it is not intended to be limited to the details shown, since various modifications and structural changes may be made without departing in any way from the spirit of the present invention. For instance, the novel positioning device is applicable in all fields where a workpiece or a stack of workpieces is required to be positioned in at least one coordinate.

Without further analysis, the foregoing will so fully reveal the gist of this invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for positioning a sheet separator arranged in an apparatus for feeding sheets from a stack, comprising means for selectively driving the sheet separator above said stack in two opposite directions; and feeler means mounted on said sheet separator to detect the position of the sheet separator relative to a rear edge of a new stack introduced during the stack exchange; and switching means controlled by said feeler means and cooperating with said driving means to impart a movement to said sheet separator in one of the two directions until the latter is in alignment with the rear edge of the stack.

2. A device as defined in claim 1, wherein said driving means includes an electric motor switchable for rotation in two opposite directions and driving a screw spindle engaging said sheet separator to advance the same in two opposite directions; said feeler means including a rear stop gauge arranged for engaging both the rear edge of the stack and the upper surface of the stack; and said switching means being arranged for rotating said motor in one direction when said stop gauge is in engagement with the upper surface of said stack and for rotating the motor in the opposite direction when the stop gauge is out of engagement with the rear edge of the stack and to stop the motor when the stop gauge engages the rear edge.

3. A device as defined in claim 2, wherein said stop gauge is slidably mounted in a guide which is rotatably supported on said sheet separator and is spring-biased into a fixed angular position in which said stop gauge is directed perpendicularly to the upper surface of said stack.

4. A device as defined in claim 3, wherein said switching means includes a first switch including two contact pins engaging each other in said fixed angular position of said stop gauge and a second switch controlled in response to the engagement of said stop gauge with the upper surface of said stack.

5. A device as defined in claim 4, wherein said feeler means includes a supporting rod arranged on said sheet separator and extending transversely to the path of its movement, a block of insulating material mounted for rotation on said supporting rod; a biasing spring for urging said block into said fixed angular position; a guide member attached to said block for guiding said stop gauge; said first switch including a first pin projecting radially from said supporting rod and a second pin projecting parallel to said rod; and said second switch being an inductive switch mounted on said block and cooperating with a flag formed on the upper end of said stop gauge.

6. A device as defined in claim 5, wherein the lower end portion of said stop gauge is slightly bent away from the rear edge of said stack and supports a feeler roll.

7. A device as defined in claim 5, wherein said switching means further includes a light barrier arranged at the desired position of the upper level of said stack.

8. A device as defined in claim 7, wherein said switching means further includes a first and a second magnetic switch for controlling the rotation of said electric motor in one of said directions; a first and a second relay controlled respectively by said inductive switch and said light barrier to activate the motor in one of said directions when a new stack is introduced into the feeding apparatus; and a first and a second auxiliary relay controlled by said first switch to interrupt ground potential when the sheet separator attains its predetermined desired position.

9. A device as defined in claim 8, wherein the first auxiliary relay is bridged by a storing capacitor and is actuated by the interruption of said light barrier.

* * * * *